US005808218A

United States Patent [19]

Grace

[11] Patent Number: 5,808,218

[45] Date of Patent: Sep. 15, 1998

[54] EXPRESSIVE MUSICAL INSTRUMENT WITH WHICH ACCURATE PITCH CAN BE PLAYED EASILY

[76] Inventor: Charles H. Grace, 30803 Breckenridge Trail, WestLake, Ohio 44145

[21] Appl. No.: 754,221

[22] Filed: Nov. 20, 1996

[51] Int. Cl.[6] ..... G10G 7/02

[52] U.S. Cl. ..... 84/456; 84/384

[58] Field of Search ..... 84/384, 454–456, 84/458, 616, 654, 681, 743, 745

[56] References Cited

U.S. PATENT DOCUMENTS

| | | | |
|---|---|---|---|
| 4,429,609 | 2/1984 | Warrender | 84/454 |
| 4,527,456 | 7/1985 | Perkins et al. | 84/723 X |
| 4,909,126 | 3/1990 | Skinn et al. | 84/454 |
| 4,947,726 | 8/1990 | Takabayashi | 84/743 |
| 5,038,657 | 8/1991 | Busley | 84/455 |
| 5,300,729 | 4/1994 | Tokunaga et al. | 84/743 X |
| 5,343,793 | 9/1994 | Pattie | 84/454 |
| 5,390,579 | 2/1995 | Burgon | 84/454 |

*Primary Examiner*—William M. Shoop, Jr.
*Assistant Examiner*—Jeffrey W. Donels
*Attorney, Agent, or Firm*—Charles H. Grace

[57] ABSTRACT

A musical instrument, for example a flute, whose hole locations are a compromise in order to produce all notes of a scale, has note-identification switches on the keys, whose combination identifies each note selected by the player. A data storage memory responds by outputting a fine-tuning signal specifying a predetermined amount of frequency-tuning bias appropriate for the selected note. A tuning device responds to the tuning signal by automatically and rapidly tuning the instrument differently as each note is played. The tuning device can be a plug in the end of the flute, moved by a motor in response to each tuning signal to bias the frequency slightly as notes are played. The player maintains complete control of pitch, volume, vibrato, etc. When in "calibrate" mode, the notes of a scale are played, the calibrator automatically compares each with the frequencies of an accurate reference scale, and stores the necessary fine-tuning data note-by-note.

22 Claims, 6 Drawing Sheets

PLAYER
BLOWING
FINGER'G
CPU MISC.
59
POW SUP
20
52
FLUTE
2
14
4
TUN'G PLUG
26
ACTU-ATOR
28
D/A
58
POS'N SENSOR
30
24
32
P
C
COMPAR-ATOR
56
ERROR
CONTACT MIC.
76
FILTERS
78
MEASURE PITCH
80
COMPAR-ATOR
82
83
44
34
46
48
53
54
NOTE DECODER
50
POSITION MEMORY
55
ADDRESS
36
WRITE DATA
WRITE COMM.
ZERO DET.
84
XTAL
74
REF. FREQ. GEN.
72

FIGURE 6

| (a) | (b) | (c) | (d) |
|---|---|---|---|
| Name of note | Frequencies of accurate equal-temperament scale | Typical frequency error of a conventional flute | Frequency error of the invented flute |
| C4 | 261.6 Hz | - 3 cent | 0 cent |
| C#4 | 277.2 Hz | - 4 cent | 0 cent |
| D4 | 294.2 Hz | 0 cent | 0 cent |
| C#5 | 554.4 Hz | +3 cent | 0 cent |

EXPRESSIVE MUSICAL INSTRUMENT WITH WHICH ACCURATE PITCH CAN BE PLAYED EASILY

REFERENCES

U.S. Pat. No. 4,429,609, issued Feb. 7, 1984, entitled "Pitch Analyzer", of inventor David J. Warrender is incorporated in and made part of the instant patent application by reference.

FIELD OF THE INVENTION

This invention relates to musical instruments, including flutes, clarinets, etc. The invention makes it easier to play on pitch with an otherwise inaccurate instrument, without sacrificing playing expression.

BACKGROUND OF THE INVENTION

Many musical instruments are more or less inaccurately intoned. That is, the frequencies of the notes are not accurate relative to each other, because of the instrument's mechanical structure. In the case of a wind instrument, the locations of the tone holes are compromises among the various notes to which they must contribute. For example, in flutes, the notes C#5 and C7 are usually sharp, while B3, C4, C#4 and D6 are usually flat. Many other notes are commonly off pitch, including F4 (usually flat) and B6 (usually sharp). In the notation being used, C4 is middle C, C5 is an octave higher, D4 is the D immediately above C4, etc. The notes that are inaccurate and the degree of the inaccuracy of each vary even among instruments of the same manufacturer.

A player may partially or completely compensate for a conventional instrument's inaccuracies of intonation by changing the manner in which he or she plays the instrument, but must compensate differently for each note.

SUMMARY OF THE INVENTION

The invention is a musical instrument that is automatically and rapidly fine-tuned, note-by-note, while it is being played. It biases the frequency, by a pre-stored amount that in general is different for each note of the scale. The instrument is played like and appears very much like a conventional instrument, but sounds better and trains the player to improve his playing.

A flute is described as an example of the invention. When the flute is being played in a usual manner it is automatically retuned at the start of each note to correct frequency errors caused by its structural deficiencies. The invented instrument makes it easier to produce frequencies that are on pitch according to a predetermined accurate scale (for example an equal-temperament scale).

With this invention, structural frequency deficiencies of the instrument are automatically corrected without taking any control away from the player. The player still produces the sound and retains the same complete control of pitch. The invention merely provides automatic compensation for structural faults. It is easier, therefore, for the player to play the frequencies that he desires; he need not correct for structural defects by blowing different notes differently. But if he wishes, he can still change the pitch instantaneously in the usual manner while playing.

Thus, just as with a flute of the conventional prior art, a player can deliberately and instantaneously raise or lower a frequency as much as desired, for artistic expression. He can do this, for example, by rotating the flute about its longitudinal axis through an angle of a few degrees, or by blowing the instrument differently in other respects. There is no automatic interference by this electronic invention with such techniques of expressive playing. The automatic electronic tuning mechanism merely identifies the note (for example, as C4), and offsets, by a previously stored amount, whatever frequency is played. The amount of the automatic-tuning bias depends only upon the note's identity (name), as indicated by the keys that are pressed, and not upon the instantaneous frequency being produced while it is being played.

The tuning required for correcting each note is stored in a memory during a calibration procedure. The player can calibrate the instrument easily with built-in equipment whenever he wishes. The stored tuning correction for each note is automatically recalled when the player plays that note.

The flute is operated by (a) switching the instrument to "Calibrate" mode and playing a chromatic scale and (b) switching it to "Play" mode and proceeding to play it. It need not be recalibrated when it is used again later.

BRIEF DESCRIPTION OF FIGURES

FIG. 6 shows a table of frequencies produced by a flute with and without corrective bias of its frequency by the invention.

DESCRIPTION OF THE PREFERRED EMBODIMENT

Arrangement of Components

Figure 1:
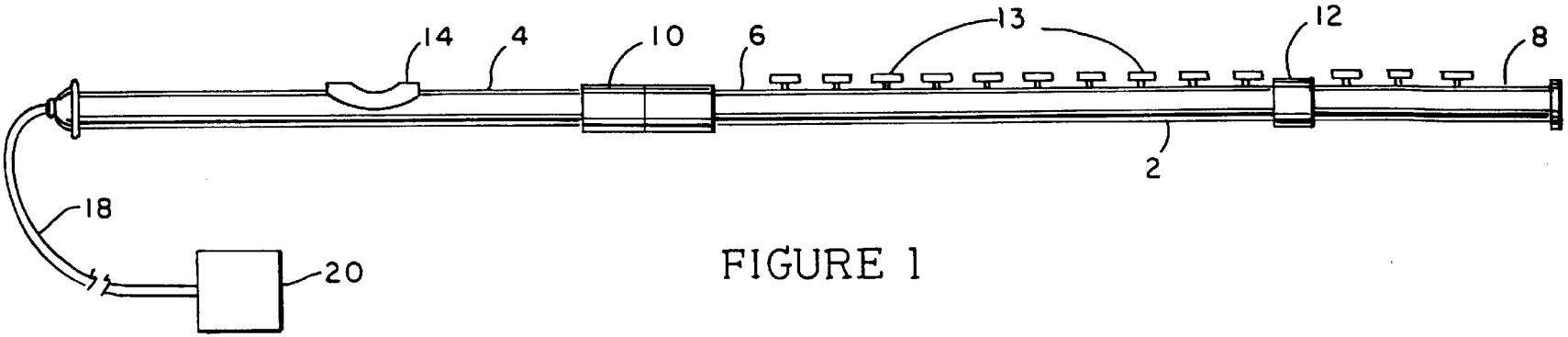
FIG. 1 shows, as an example, a flute that incorporates the invention.
Figure 2:
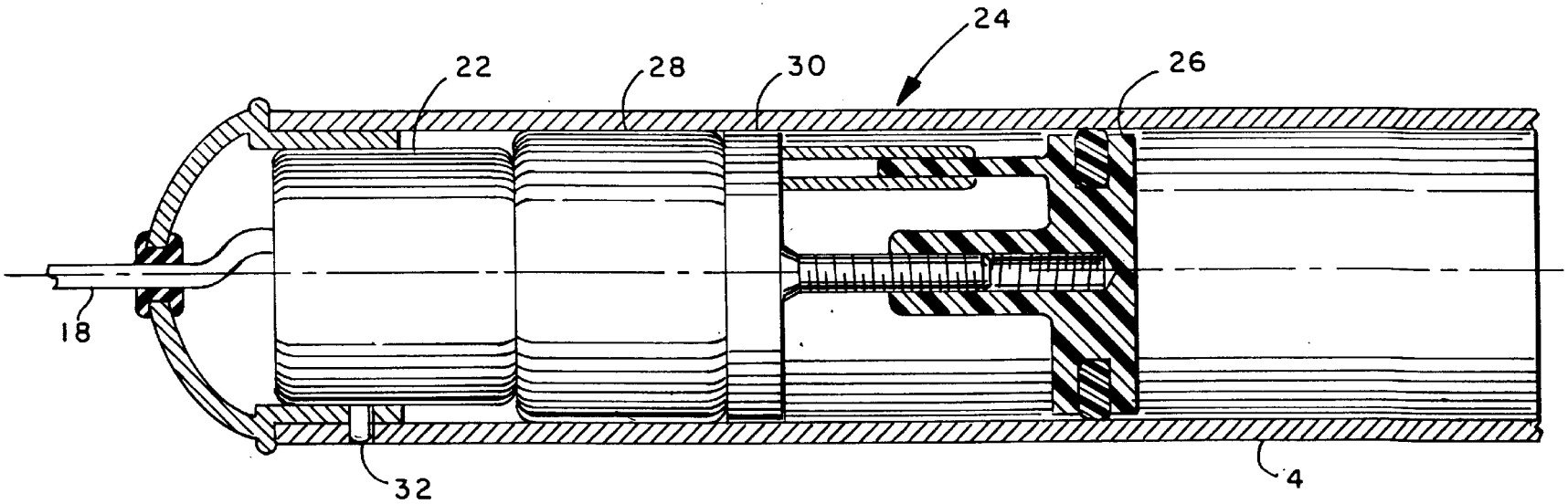
FIG. 2 is a cross-sectional view of a portion of a preferred embodiment of the flute.

FIGS. 1 and 2 show the appearance of a preferred embodiment of the flute and the mechanical arrangement of its major components. In FIG. 1, three major sections of a flute 2 are shown, namely a head section 4, a body section 6, and a foot section 8. The head and body sections are connected by a sliding joint having a fourteen-contact electrical connector, whose contacts are distributed around the periphery at equal angles in a sleeve 10. The body section 6 is connected to the foot section 8 by a sliding joint having three electrical connectors spaced apart around the periphery in a sleeve 12. The body and foot sections have conventional finger keys 13 for selecting notes to be played.

A conventional embouchure hole 14 is set in the head section 4. When, as is preferable, the instrument is operated from an external power supply 20 instead of by batteries in the flute, a thin electrical cable 18 is connected from the electronics flute to the power supply 20.

As shown in the partial cutaway view of FIG. 2, the head section 4 houses an electronic circuit 22 and a tuning system 24. The tuning system 24 includes a tuning plug 26, which is at the end of a movable armature of a linear actuator 28. Also included is a position sensor 30 that senses the position of the plug 26 by sensing the position of the movable part of the actuator 28. Wiring connections are omitted from FIG. 2 for clarity.

The instrument has a "Play" circuit and a "Calibrate" circuit, which are selectable manually by a mode switch 32, FIG. 2. In the following paragraphs, the structure and operation of the "Play" circuit are described first, then the structure and operation of the "Calibrate" circuit. The same finger-key circuit, tuning system, position-data memory, power supply and miscellaneous CPU circuits are used for both "Play" and "Calibrate". Components that are used in common by both the "Play" and "Calibrate" circuits are in the description of the "Play" circuit.

Structure of "Play" Circuit

Figure 3:
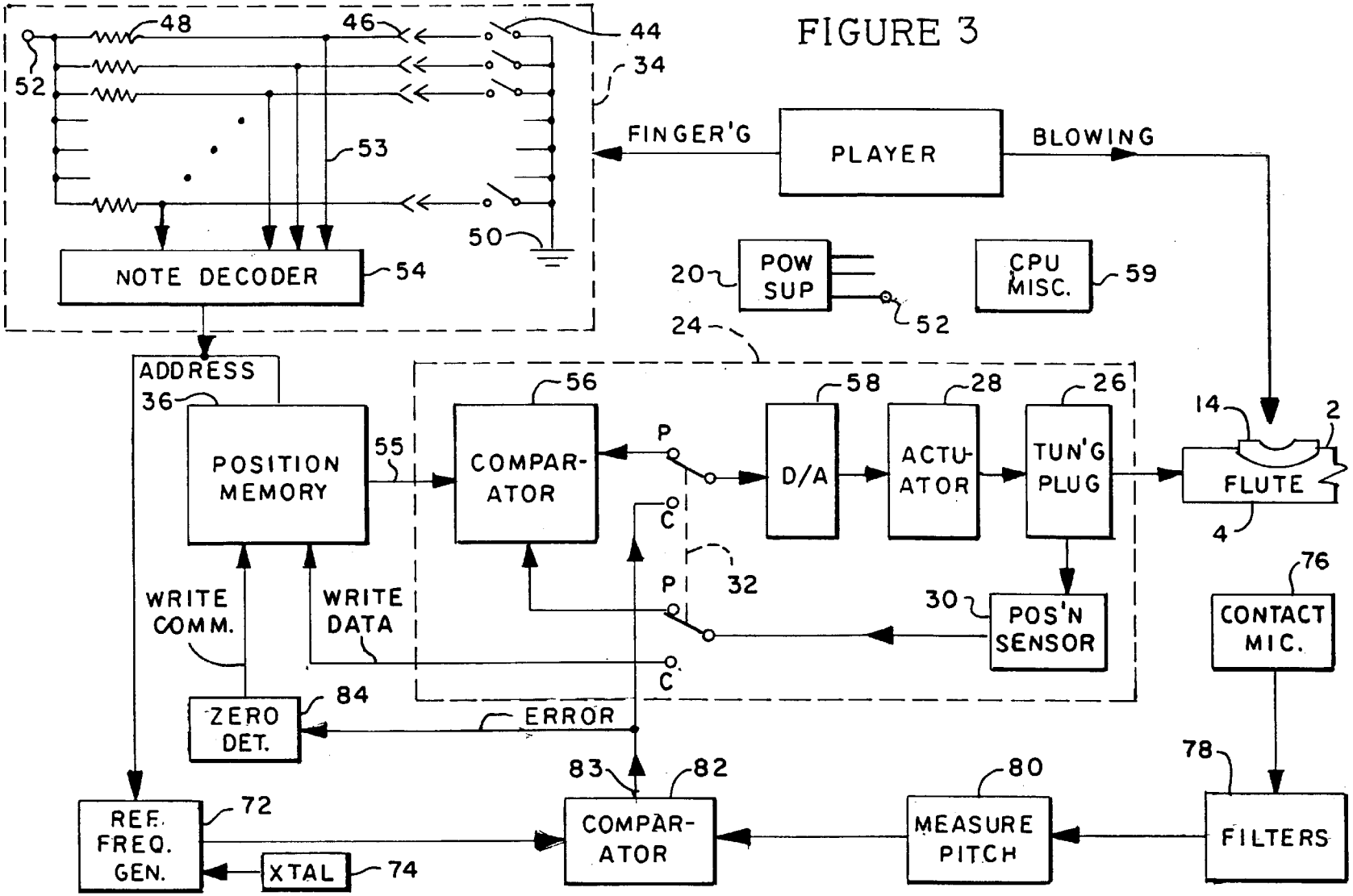
FIG. 3 is a simplified electronic block diagram of the preferred embodiment

Main elements of the "Play" circuit are shown, with some simplifications for clarity, in FIG. 3. All components of the "Play" circuit are well known in the prior art; it is their arrangement and purpose that make the present invention novel. The preferred embodiment of the "Play" circuit comprises the following elements, which are described in more detail in subsequent paragraphs:

A. A note-identification circuit 34 for identifying the intended note based upon the combination of presently selected keys.

B. A position-data memory 36 that holds a plurality of previously developed calibration data defining, for each note, a correct position of the tuning plug.

C. The tuning system 24, which includes a closed control loop for actuation of the tuning element 26.

A. Note-Identification Circuit 34

Just as in a conventional flute of the prior art, each different combination of finger keys 13 that the player presses identifies a note that the player intends to play. In the preferred embodiment the positions of the finger keys 13 are detected by key-actuated switches 44, each of which is connected through a connector 46 (in sleeve 10) to a pull-up resistor 48. The pull-up resistors are connected to a DC power supply terminal 52. When a switch 44 is closed, one end of the corresponding pull-up resistor 48 is connected to ground at a point 50. A conductor 53 from the connector 46 and the resistor 48 conducts the switch signal to a note identification decoder 54 to indicate the status of the switch. The decoder 54 produces a "note-identification" signal based upon the combination of keys that are depressed.

This method for identifying a selected note is commonly used in the prior art, for example in a musical instrument called "Windjammer Model EW-20", which is available from Yamaha Corporation, 3445 East Paris Avenue SE, P.O. Box 899, Grand Rapids, Mich., 49512. Another prior-art musical instrument that utilizes this key-switch means of identifying a note is a "Digital Horn Model DH100", whose sale by Casio Corporation of Japan has been discontinued. Both the Windjammer Model EW-20 and the Digital Horn Model DH100 use the key combinations only to select and produce a desired note, not to tune the instrument while it is being played, so the purpose and use are different from those of the present invention.

Position-Data Memory 36

The note-identification signal from decoder 54 is connected to the position-data memory 36, where it addresses a storage location where correct-position data for use by the tuning system is stored. A conductor 55 carries the correct-position data from the memory 36 to a comparator 56.

Tuning Circuit 24

The tuning circuit comprises (a) the present-position sensor 30 for sensing the present position of the tuning plug and outputting a present-position signal; (b) the comparator 56 for comparing the present-position signal with the correct tuning position for the intended note as read from the memory 36, and outputting an error signal accordingly; (c) a digital-to-analog (D/A) converter 58; and (d) an actuator 28 that is responsive to the error signal for moving the tuning plug 26 to the correct position. The signal from sensor 30 is connected to the comparator 56 through a first pole of a mode switch 32.

The comparator 56 outputs an error signal, which passes through a second pole of the mode switch 32 to the digital-to-analog (D/A) converter 58. From the output terminal of the D/A 58 an analog signal is connected to the actuator 28 for moving the tuning plug 26.

The tuning circuit 24 is a closed loop comprising the blocks 56, 32, 58, 28, 26 and 30. The tuning plug 26 defines the end of the air column at the mouthpiece end of the flute, as in prior art flutes. A disk on the movable armature of the linear actuator 28 serves as a tuning plug 26 for the preferred embodiment. Preferably, both the actuator 28 and the present-position sensor 30 are parts of a conventional unitary servo component device for positioning an armature and sensing its position. These devices, which are known in Thomas Register as "positioners", are commercially available from many companies. The movable elements of the actuator is light enough to respond quickly to the actuation force, but massive enough not to respond significantly to vibrations at the frequencies of the tones produced by the flute.

The mode switch 32 is connected to select a different source of input signal to the D/A 58 for "Calibrate" than for "Play", and to select a different destination for the output signal of the present-position sensor 30 when in "Calibrate" position than when in "Play" position.

External Circuits

Preferably, some of the circuits of the instrument are off the flute itself. The external circuits 20 are in a separate housing for placement in the player's clothing or elsewhere, and connected to the flute by the thin electrical cable 18. The external circuits 20 include a conventional line-operated power supply that provides low-voltage power required by the various circuits. The DC voltage at terminal 52 is one of its several outputs, another being a very constant reference voltage. Single-output power supplies known as converters or line adapters are readily available in retail stores, but one that is purpose-built for the required voltages is preferably employed here.

Miscellaneous CPU Equipment

The CPU has various conventional "housekeeping" programs involving routine design of the position-data memory 36 and other components. They are indicated as block 59 of FIG. 3.

Operation of the "Play" Circuit

Figure 4:
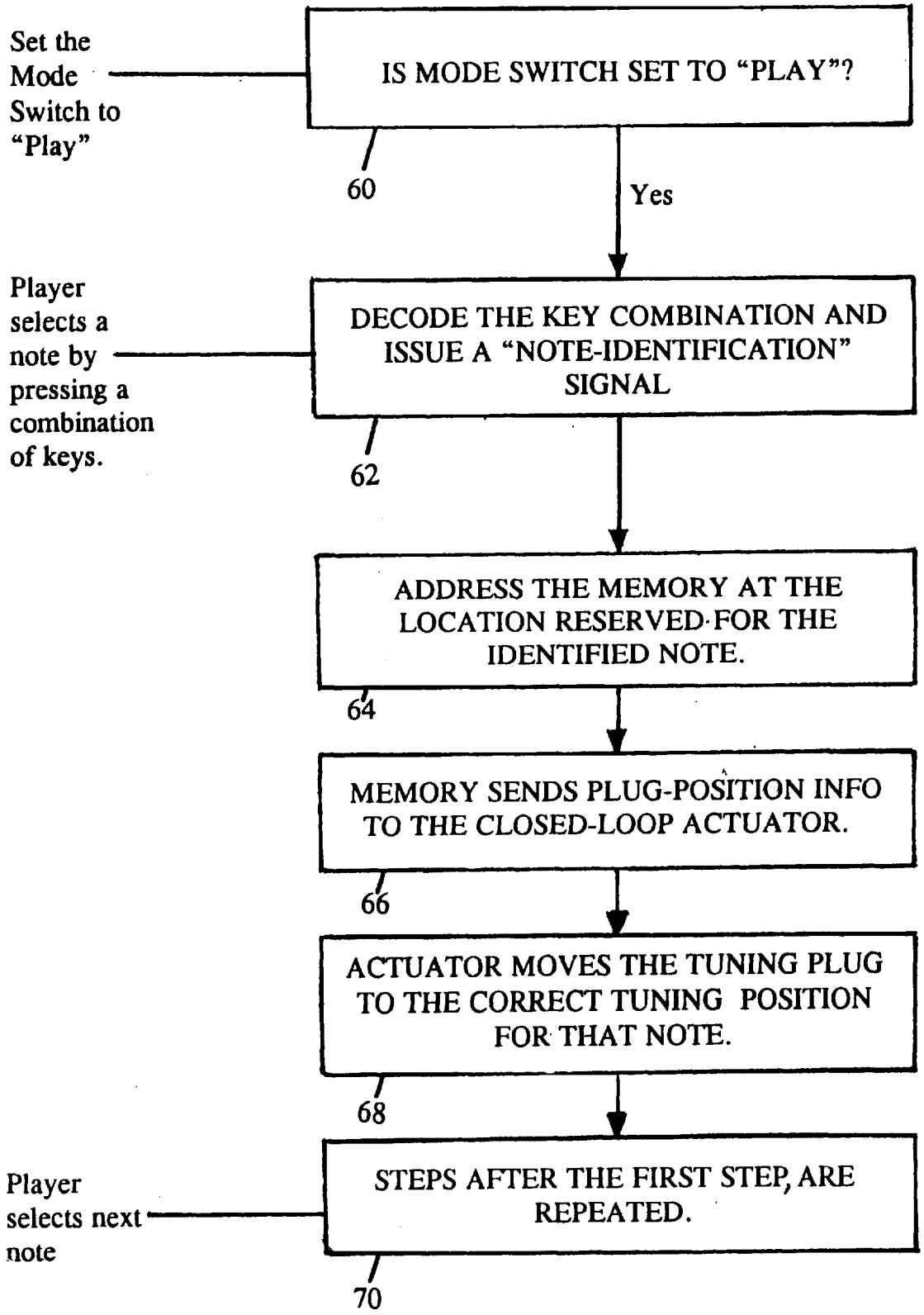
FIG. 4 is a simplified flow chart of a microcomputer program for the "Play" mode of operation.

The instrument is automatically tuned anew upon the playing of each different note, to a tuning position tailored to the note being played. The preferred way to accomplish the fine tuning is rapidly to reset the position of the tuning plug 26 of the flute when a note is selected, and to leave the tuning plug in that new position until a different note is played. A flow chart for control of the flute in the "Play" mode is shown in FIG. 4. The steps in playing the instrument and the reference numbers that indicate them in FIG. 4 are:

Ref No. 60. Set the Mode Switch 32 to the "Play" Position.

Ref No. 62. Select a note by pressing a combination of keys 13, which actuate the switches 44. The note-identification decoder 54 receives signals dependent upon the selected combination of switches, and issues a "note-identification" signal that corresponds uniquely to that note.

Ref. No. 64. To each of the notes there corresponds stored tuning data in the position-data memory 36. For example, one tuning position is stored for C4, another for C#4, another for D4, etc. The note-identification signal addresses the storage location in memory 36 at which the tuning data for the selected note is stored.

Ref No. 66. Position data is read out from memory 36 to the tuning circuit 24.

Ref No. 68. The position data from memory 36 serves as a tuning control signal for directing the closed-loop control circuit 24. The closed-loop control circuit 24 quickly moves the tuning plug 26 to the correct bias position for that particular note.

Ref. No. 70. When the player selects the next note the process of steps 62 to 68 is repeated.

In this way the array of tuning control signals that were determined and stored in memory 36 during calibration (described below) are called upon for rapid tuning of individual notes while the instrument is being played.

Structure of Calibrator

The structural components of the calibrator are also shown in FIG. 3. The "Play" and "Calibrate" circuits employ some components in common. All components of the calibrator are well known in the prior art. It is their arrangement and purpose that make the present invention novel.

The calibrator includes the following components:

A. The note-identification circuit 34 (described above), that identifies an intended note by sensing the combination of keys 13 that are selected by the player. The circuit 34 activates a corresponding reference frequency.

B. A reference-frequency generator 72 that receives the note-identification signal from circuit 34. The generator 72 has a digital circuit capable of producing an array of frequencies, each of which corresponds to the frequency of a note of a chromatic scale. Chromatic-scale frequency generators are common in electronic organs, etc. The generator 72 employs a clock oscillator with a crystal 74, which controls the reference frequencies, and it generates each desired reference frequency as it is needed during calibration.

C. A contact microphone 76 receiving tones produced when a note is blown on the flute, and frequency filters 78 for cleaning the spectrum of the note for easier measurement. The calibration circuit includes a closed control loop comprising blocks 76, 78, 80, 82, 24 and 4.

D. A frequency sensor 80 for sensing the frequency of the tone sensed by the microphone.

E. A frequency comparator 82 for comparing the reference frequency received from generator 72 with the frequency of the played tone as received from block 80, and outputting an error signal at terminal 83. The error signal passes through a pole of the mode switch 32.

F. The digital-to-analog converter 58, described above, for receiving the digital output of the comparator 82 via the mode switch 32, and converting it to an analog signal.

G. The actuator 28 described above, for receiving the output of the D/A converter 58 and moving the tuning plug 26 in response to the error signal. Relocation of the tuning plug alters the frequency of the played tone to equal the reference frequency dictated by the reference-frequency generator 72.

H. the present-position sensor 30 described above, for sensing the present position of the tuning plug 26 and outputting a present-position signal accordingly, which passes through a pole of the switch 32, to write into the position-data memory 36.

I. A zero detector 84, receiving the error signal that is output from the digital comparator 82, and issuing a write command to the position-data memory 36 to store the final position of the tuning plug 26 in the memory when the error signal is zero. The zero detector 84 detects the time at which the frequency of the acoustic tone being produced equals the reference frequency. Thereupon, it commands the memory 36 to store the position signal (the write data from 30) of the tuning plug 26, in a storage address corresponding to the note, as addressed by the decoder 54.

J. The miscellaneous CPU computer control subcircuits 59.

The above-cited patent describes details of prior art analog signal-processing circuitry and digital computing and display circuitry for measuring the frequency of a musical sound and outputting a signal indicating the frequency, as well as the error of the frequency relative to an internally stored frequency-reference system.

Operation of Calibrator

Figure 5A:
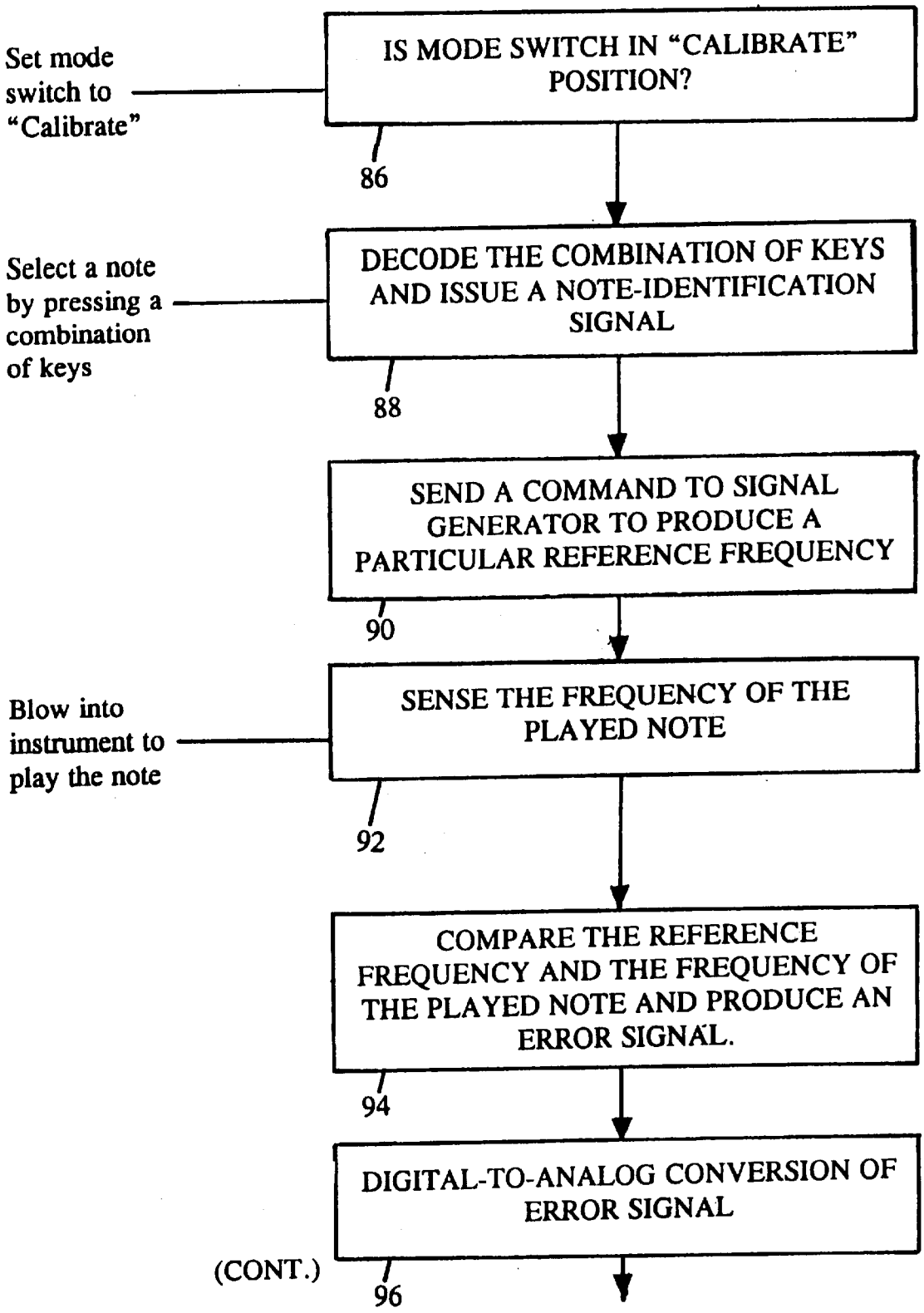
FIGS. 5A and 5B together are a simplified flow chart of a microcomputer program for the "Calibrate" mode of operation of the instrument.
Figure 5B:
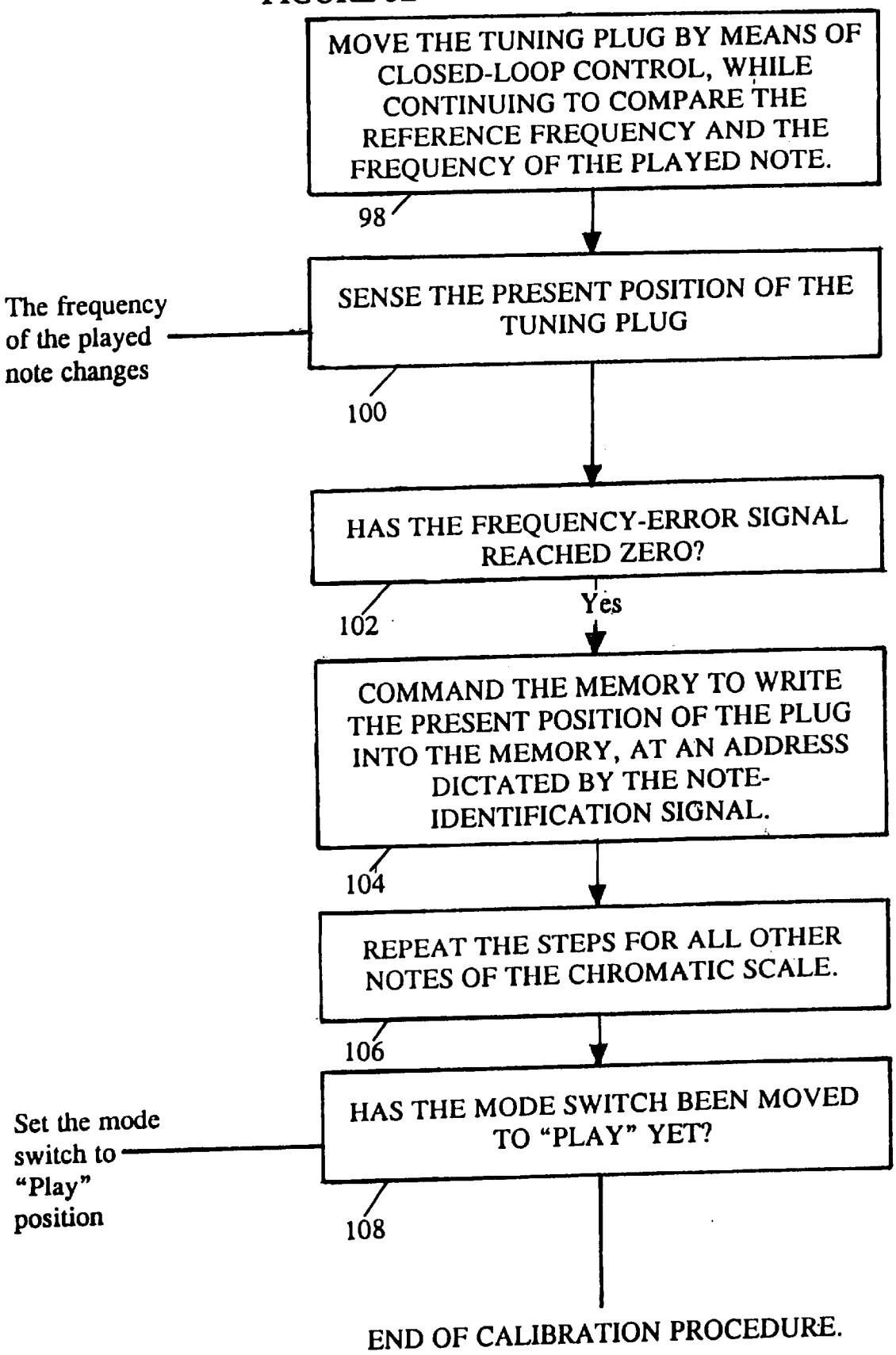

The preferred embodiment of the instrument is calibrated by manually switching the instrument to "Calibrate" mode and playing each note of the chromatic scale throughout the range of the instrument. As each individual note is played during calibration, the tuning bias that is required to achieve accurate intonation is automatically stored in the memory 36. In general, the stored information is different for each note. A flow chart for control of the calibrator is shown in FIGS. 5A and 5B. Steps in calibrating the instrument and the reference numbers of the steps shown on FIGS. 5A and 5B are:

Ref. No. 86. Set the mode switch 32 to "Calibrate" position and verify its position..

Ref No. 88. Select a note by pressing a combination of keys 13 in a conventional manner. The instrument decodes the selected combination of keys in decoder 54, and produces an electronic note-identification signal.

Ref No. 90. The note-identification signal automatically activates a corresponding reference frequency in the reference-frequency generator 72.

Ref. No. 92. Blow into the instrument to play the selected note, which is picked up by the contact microphone 76. The circuit 80 measures the frequency of the played note and outputs a signal accordingly.

Ref. No. 94. The comparator 82 compares the frequency of the played note with the corresponding reference frequency from generator 72, and outputs a signal based upon the error between the two frequencies.

Ref No. 96. The D/A converter 58 converts the digital error signal from 82 into an analog signal, and applies it to the actuator 28.

Ref. No. 98. The error signal automatically moves the tuning plug 26 to tune the instrument toward the selected reference frequency, using the closed-loop control circuit described above.

Ref No.100. The frequency of the note being played changes, because of relocation of the tuning plug 26. The actual position of the tuning plug is sensed by device 30.

Ref. No. 102. When the error signal from comparator 82 reaches zero, that fact is detected by the zero detector 84.

Ref. No. 104. The zero-detector 84 issues a write command. When the write command is received at the memory 36 the instrument automatically stores in memory the present position of the plug 26. The present position of the plug 26 is the "write data", which comes through a pole of the switch 32 from the position sensor 30. The address at which the present position is stored corresponds to the particular note, as dictated by the note-identification circuit 34. Thus during calibration the instrument is automatically tuned to bring the played note to the reference pitch, and the amount of bias required is stored in memory 36. 106. Play all other note s of the chromatic scale, so that the foregoing calibration steps 38 to 104 are automatically repeated for all notes.

108. End the calibration procedure by setting the mode switch to the "Play" position.

After calibration is complete and the instrument is in the "Play" position, an appropriate correct-position signal is quickly recalled from the memory as each note is played. The signal is sent to the tuning plug, and used to tune the instrument.

Vibrato and Overall Tuning

Vibrato can be produced by the player in the usual prior-art manner.

The entire instrument can be tuned overall to a slightly higher or lower frequency by changing the reference frequency of the central processing unit (CPU) of the microcomputer. After calibration, overall tuning can be accomplished by manually sliding the head section of the instrument relative to the body section, as is done in tuning non-electronic prior art flutes. Individual notes do not require recalibration after the flute as a whole is tuned to a slightly sharper or flatter overall setting, because the optimum stored plug positions are affected only insignificantly by such relatively small overall changes.

Instrument Performance

FIG. 6 shows that a great amount of frequency tuning must be accomplished by player techniques with a prior art flute in order to play on pitch. It also show s that, with the invented flute, no frequency adjustment need be accomplished by player techniques in order to play on pitch. Column (a) lists four notes, namely C4, C#4, D4 and C#5, which are merely examples from a full chromatic spectrum of musical notes. Column (b) of FIG. 6 shows accurate equal-tempered-scale frequencies of those four notes.

Column (c) shows the frequency errors produced by one prior-art flute without the invention. It has structurally-caused defects of frequency intonation. The frequency errors shown are without any player compensation. The expression "without any player compensation" here means that the blowing and other techniques are like those which would occur if the instrument were blown by a machine, with uniform flow and with no axial rotation of the body of the flute relative to the blowing machine.

Column (d) shows that zero or negligible frequency errors are produced by the invented flute, even without any player compensation. These corrected frequencies are the same as those of a prior art flute when the defects of the prior-art flute are skillfully compensated by the technique of an expert player (and without any intentional offset by the player for expression). The player still has the exactly the same ability as he had in the prior art, to play slightly sharp or slightly flat, for expression, if he desires.

SOME OTHER EMBODIMENTS

The same inventive principles apply to many other instruments in addition to flutes. The invention is applicable to stringed instruments as well as wind instruments. For stringed instruments, the tuning is preferably accomplished by changing the axial tension of the string, although the string's length could be changed. Automatic tuning can be applied either separately to each individual note or alike to all of the notes that are on the same string.

Various other embodiments can also be made for flutes and other instruments.

Although in the preferred embodiment the positions of the finger keys are detected by key-actuated switches, other sensors of key positions, for example capacitive proximity sensors, could be employed instead.

To identify the desired note, a frequency sensor can sense the frequency of a tone that is played, and the sensed frequency can be automatically categorized as being within the one frequency band or range that characterizes it as being a particular note.

An alternative method of overall tuning after calibration is to move the entire tuning plug mechanism axially to a different position within the head section. The present-position sensor is preferably moved along with the tuning plug.

For calibration, if desired, an adaptor can be affixed temporarily to a flute's headpiece to standardize the blowing angle, and the player can merely blow into the free end of the adaptor (blowing at the same rate of flow for all notes), to produce tones for calibration. This ensures that a player is not unintentionally distorting the calibration signals to reduce the error. This degree of care is ordinarily not convenient nor necessary.

Although the "Calibrate" circuit preferably employs a reference-frequency generator based on a clock oscillator, and generates each desired reference frequency when it is needed during calibration, it could instead use a larger non-volatile data storage memory, in which a plurality of the desired reference frequencies are retained simultaneously after having been previously generated.

The "Play" circuit can use an open-loop control circuit to move the tuning plug instead of the preferred closed-loop control circuit of block 24. The preferred embodiment of the "Calibrate" circuit also employs a closed-loop control circuit for moving the tuning plug, but an open-loop circuit could be used instead if desired.

Numerous alternatives are available for moving the tuning plug in response to control signals. The actuator device can be a serially stacked set of piezoelectric crystals, or a linear motor, or a voice-coil in a magnetic field, etc. A rotary motor can be spinning all the while the instrument is being played, and a forward or reverse clutch can be actuated for a time interval to advance or retract the tuning plug.

If desired, none of the equipment need be located off the musical instrument, instead of being in a packet on the player's belt and connected to the body of the instrument by an electrical cable.

The instrument could be operated by batteries or from an electric utility power source.

The scope of the invention is determined by the claims.

What is claimed is:

1. A musical instrument having acoustic tone-producer means for producing a plurality of player-selected notes, comprising:

note-identification means for providing a note-identification signal identifying each player-selected note;

data storage means addressable by said note-identification signal and responsive thereto for outputting a tuning signal, said tuning signal specifying a predetermined amount of frequency-tuning bias corresponding to each of said player-selected notes;

tuning means whose adjustment would simultaneously affect the tuning of a plurality of notes if any note of that plurality were played, said tuning means receiving said tuning signal and being responsive thereto for automatically tuning said acoustic tone-producer means individually as each individual note is played in turn.

2. An instrument as in claim 1 and wherein said note-identification means comprises means for providing a digital note-identification signal.

3. An instrument as in claim 1 and wherein said tuning means comprises:

a tuning member mounted for movement relative to said acoustic tone-producer means, for affecting the frequencies produced by said acoustic tone-producer means;

actuator means for moving said tuning member in response to said tuning signal to a bias position to change the frequency by the amount of said frequency-tuning bias as notes are played.

4. A musical instrument having acoustic tone-producer means for producing a plurality of player-selected notes, comprising:

note-identification means for providing a note-identification signal identifying each player-selected note;

data storage means addressable by said note-identification signal and responsive thereto for outputting a tuning signal, said tuning signal specifying a predetermined amount of frequency-tuning bias corresponding to each of said player-selected notes;

tuning means receiving said tuning signal and responsive thereto for automatically tuning said acoustic tone-producer means differently as each individual note is played;

said instrument having keys for actuation in various combinations by a player, for selection of notes, and wherein said note-identification means comprises:

means for sensing which keys are presently actuated by the player; and means for recognizing the selected note in response to the combination of keys that are actuated; and means for producing said note-identification signal in response to said means for recognizing.

5. An instrument as in claim 4 and wherein said means for sensing which keys are presently actuated comprises switch means disposed for actuation when said keys are actuated, and signalling the actuation of a switch.

6. An instrument as in claim 4 and wherein:

said means for recognizing the selected note in response to the combination of keys that are actuated comprises electronic decoder means that is responsive to predetermined combinations of keys that are actuated, and said means for producing said note-identification signal comprises means connected with said electronic decoder means and responsive to the actuation of a predetermined combination of keys for addressing said data storage means.

7. A musical instrument having acoustic tone-producer means for producing a plurality of player-selected notes, comprising:

note-identification means for providing a note-identification signal identifying each player-selected note;

data storage means addressable by said note-identification signal and responsive thereto for outputting a tuning signal, said tuning signal specifying a predetermined amount of frequency-tuning bias corresponding to each of said player-selected notes;

tuning means receiving said tuning signal and responsive thereto for automatically tuning said acoustic tone-producer means differently as each individual note is played;

and wherein said tuning means comprises:

a tuning member mounted for movement relative to said acoustic tone-producer means, for affecting the frequencies produced by said acoustic tone-producer means;

actuator means for moving said tuning member in response to said tuning signal to a bias position to change the frequency by the amount of said frequency-tuning bias as notes are played;

and wherein said tuning means comprises closed-loop tuning means responsive to the difference between the present position of said tuning means and said bias position.

8. An instrument as in claim 5 and wherein said closed-loop tuning means comprises:

sensing means for sensing the present position of said tuning means and outputting a present-position signal accordingly;

comparator means for comparing said present-position signal with said bias position, and outputting an error signal in accordance with the difference;

actuator means for moving said tuning element in response said error signal to reduce said difference.

9. A musical instrument having acoustic tone-producer means for producing a plurality of player-selected notes, comprising:

note-identification means for providing a note-identification signal identifying each player-selected note;

data storage means addressable by said note-identification signal and responsive thereto for outputting a tuning signal, said tuning signal specifying a predetermined amount of frequency-tuning bias corresponding to each of said player-selected notes;

tuning means receiving said tuning signal and responsive thereto for automatically tuning said acoustic tone-producer means differently as each individual note is played;

and wherein said tuning means comprises:

a tuning member mounted for movement relative to said acoustic tone-producer means, for affecting the frequencies produced by said acoustic tone-producer means;

actuator means for moving said tuning member in response to said tuning signal to a bias position to change the frequency by the amount of said frequency-tuning bias as notes are played;

and wherein said instrument is a flute and said tuning member comprises a stop for the end for the air column of said flute, proximate the end of the flute which is nearer the mouthpiece.

10. A calibrator for a musical instrument, said instrument having acoustic tone-producer means for producing a plurality of player-selected notes, as well as note-identification means (34); comprising:

frequency-reference means (72) for making available a plurality of reference-frequency signals, said reference-frequency signals corresponding to said plurality of selectable notes and being responsive to be accessed by said note-identification means (34);

means (80) for sensing the frequency of each played tone produced by said acoustic tone-producer means during calibration and producing a played-frequency signal dependent upon the frequency played;

comparison means (82) receiving said played-frequency signal and a corresponding one of said reference-frequency signals, for comparing the frequency of the played note with said reference-frequency signal, and providing a frequency-error signal (83) accordingly, associated with the identified note;

means (32C, 58, 28, 26, 30, 84) receiving said frequency-error signal (83) for the identified note, for converting said frequency-error signal to a tuning-position signal;

data storage means (36) connected to be addressed by said note-identification means (34), for storing said tuning-position signal (30).

11. A calibrator as in claim 10 and wherein said means for sensing the frequency of each tone comprises acoustic transducer means (76) and digital means for outputting a digital signal corresponding to the played frequency sensed by said transducer means.

12. A calibrator as in claim 10 and wherein said storage means (36) comprises means for storing and outputting representations corresponding to said correction signals.

13. A calibrator as in claim 10 and wherein said frequency-reference means comprises a clock signal generator (74) and frequency generation means (72) for generating data specifying a plurality of reference frequencies.

14. A calibrator as in claim 10 and wherein said frequency-reference means (72) comprises memory means for storing representations of a plurality of said reference frequencies.

15. A calibrator as in claim 10 and wherein said data storage means (36) comprises means for similarly storing a tuning-position signal corresponding to each other note produced upon playing of the instrument during calibration, so as to retain simultaneously an array of said tuning-position signals, each of which corresponds to a respective note.

16. A closed-loop calibrator for a musical instrument, said instrument having acoustic tone-producer means for producing a plurality of player-selected notes, comprising:

note-identification means (34) for providing a note-identification signal identifying each player-selected note;

frequency-reference means (72) for making available a plurality of reference-frequency signals, said reference-frequency signals corresponding to said plurality of selectable notes and being responsive to be accessed by said note-identification means;

means (80) for sensing the frequency of each played note produced by said acoustic tone-producer means during calibration and producing a played-frequency signal dependent upon the frequency played;

comparison means (82) receiving said played-frequency signal and a corresponding one of said reference-frequency signals, for comparing the frequency of the played note with said reference-frequency signal, and providing a frequency-error signal (83) accord to their difference;

means (32C, 58, 28, 26, 30, 84) for providing a tuning-position signal, said means receiving said frequency-error signal (83) and being responsive thereto automatically to tune said instrument to said reference pitch while the note is being played, comprising: (a) a tuning means (26) receiving a representation of said frequency-error signal (83) and being responsive thereto for tuning said acoustic tone-producer means differently as each individual note is played, and (b) means (30) for sensing the present position of said tuning means (26) and outputting a present-position calibration signal accordingly;

position memory means (36) for receiving and storing said present-position calibration signal.

17. A closed-loop calibrator as in claim 16 and wherein said means for providing a tuning-position signal further comprises zero-detection means (84) for detecting when said frequency-error signal (83) becomes zero, and for thereupon issuing a write command to said position memory means (36) to store said present-position calibration signal (30) in said position memory means (36).

18. A method for tuning an instrument note-by-note while it is being played, comprising the steps of automatically:

identifying a player-selected note and producing a corresponding note-identification signal;

addressing a data storage means with said note-identification signal, and in response thereto, accessing and outputting a tuning-position signal specifying a predetermined amount of tuning bias corresponding to said player-selected note;

in response to said tuning-position signal, automatically adjusting a tuning element to tune said instrument differently while that individual identified note is being played, even though said tuning element affects a plurality of other notes that could have been played.

19. A method for, when each of a plurality of notes is played, tuning an instrument that has a tuning member whose setting affects said plurality of notes, comprising the steps of:

identifying each note of a sequence of player-selected notes by actuating a sequence of combinations of keys;

automatically detecting said combinations of keys, and in response thereto, producing a corresponding sequence of note-identification signals;

addressing a data storage means with said note-identification signals, and in response thereto, outputting from said data storage means a sequence of tuning-position signals, each specifying a predetermined amount of tuning bias corresponding to said player-selected note;

automatically tuning said instrument differently for the duration of the playing of each individual note, in response to said tuning-position signals, whereby the setting of said tuning member changes as the notes being played change.

20. A method for calibrating an instrument for note-by-note tuning as the instrument is subsequently played, comprising the steps of:

playing a note and sensing the frequency of said played note as it is played;

identifying the note by sensing the combination of keys that are depressed to select the note, and producing a corresponding note-identification signal;

in response to said note-identification signal, accessing a reference frequency corresponding to said note, from among of a plurality of reference frequencies corresponding to the identities of a plurality of notes;

comparing the frequency of the played note with the corresponding reference frequency, and outputting a difference signal based upon the difference between the two frequencies;

in response to said difference signal, automatically tuning the instrument to said reference frequency by positioning a tuning element of the instrument;

storing in memory the as-tuned position of the tuning element, at a memory address corresponding to said note.

21. A method as in claim 20 and wherein said step of accessing a reference frequency from among a plurality of reference frequencies corresponding to the identities of a plurality of notes comprises storing a plurality of reference frequencies in a memory.

22. A method as in claim 20 and wherein said step of accessing a reference frequency from among a plurality of reference frequencies corresponding to the identities of a plurality of notes comprises generating each reference frequency by basing each reference frequency on a signal from a clock signal generator.

* * * * *